US011214346B1

(12) United States Patent
Jaeger et al.

(10) Patent No.: US 11,214,346 B1
(45) Date of Patent: Jan. 4, 2022

(54) OUTBOARD MOTOR WITH COMPLIANT COWL MOUNTING

(71) Applicant: Brunswick Corporation, Mettawa, IL (US)

(72) Inventors: Matthew W. Jaeger, Oshkosh, WI (US); Timothy D. Krupp, Fond du Lac, WI (US); Bradley R. Stafford, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/000,541

(22) Filed: Aug. 24, 2020

(51) Int. Cl.
*B63H 20/32* (2006.01)
*B63H 20/02* (2006.01)

(52) U.S. Cl.
CPC ..... *B63H 20/32* (2013.01); *B63H 20/02* (2013.01); *B63H 2020/025* (2013.01)

(58) Field of Classification Search
CPC .. B63H 20/32; B63H 20/02; B63H 2020/025; B63H 21/26; B63H 21/36
See application file for complete search history.

(56) References Cited

U.S. PATENT DOCUMENTS

| | | | | |
|---|---|---|---|---|
| 4,507,090 | A | 3/1985 | Kobayashi et al. | |
| 5,180,319 | A | 1/1993 | Shiomi et al. | |
| 8,820,701 | B1 | 9/2014 | Eichinger | |
| 8,932,093 | B2 * | 1/2015 | Hagi | B63H 20/08 440/53 |
| 9,205,906 | B1 | 12/2015 | Eichinger | |
| 9,216,805 | B1 | 12/2015 | Amerling et al. | |
| 9,376,191 | B1 | 6/2016 | Jaszewski | |
| 9,446,828 | B1 | 9/2016 | Groeschel et al. | |
| 9,475,560 | B1 | 10/2016 | Jaszewski et al. | |
| 9,481,439 | B1 | 11/2016 | Groeschel et al. | |
| 9,580,943 | B1 | 2/2017 | Amerling et al. | |
| 9,580,947 | B1 | 2/2017 | Amerling et al. | |
| 9,623,948 | B1 | 4/2017 | Waldvogel et al. | |
| 9,643,703 | B1 | 5/2017 | Eichinger | |
| 9,701,383 | B1 | 7/2017 | Stuber et al. | |
| 9,963,213 | B1 | 5/2018 | Jaszewski et al. | |
| 9,969,475 | B1 | 5/2018 | Waisanen | |
| 10,005,534 | B1 | 6/2018 | Amerling et al. | |
| 10,150,549 | B1 | 12/2018 | Amerling et al. | |
| 10,351,222 | B1 | 7/2019 | Amerling et al. | |
| 10,464,648 | B1 | 11/2019 | Amerling et al. | |

* cited by examiner

*Primary Examiner* — Stephen P Avila
(74) *Attorney, Agent, or Firm* — Andrus Intellectual Property Law, LLP

(57) ABSTRACT

A marine drive is provided. The marine drive includes a propulsion unit, a supporting cradle that couples the propulsion unit to a transom bracket for attachment to a marine vessel, and a cowling system that at least partially covers a portion of the propulsion unit and a portion of the supporting cradle. The cowling system includes multiple cowl components, and at least one of the multiple cowl components is coupled to the supporting cradle using an elastic cowl mount assembly. The elastic cowl mount assembly includes a conical bushing coupled to the cowl component, an external housing coupled to the supporting cradle, and a compliant body coupled to the conical bushing and the external housing. The compliant body permits radial and axial movement of the conical bushing relative to the external housing.

20 Claims, 7 Drawing Sheets

OUTBOARD MOTOR WITH COMPLIANT COWL MOUNTING

FIELD

The present disclosure relates to outboard motors, and more particularly to elastic cowl mounting arrangements for outboard motors.

BACKGROUND

U.S. Pat. No. 10,351,222 discloses a cowling for a marine drive. The cowling has a first cowling portion and a second cowling portion that mates with the first cowling portion along a perimeter edge so as to enclose the marine drive. A perimeter seal is disposed along the perimeter edge and is axially sandwiched between the first cowling portion and the second cowling portion to thereby prevent ingress of water into the cowling. The perimeter seal is retained on the second cowling portion and is axially compressed against the first cowling portion when the second cowling portion is axially mated with the first cowling portion.

U.S. Pat. No. 9,701,383 discloses a marine propulsion support system that includes a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,643,703 discloses an arrangement for coupling a vibration isolation mount to an outboard motor. A pocket is formed in a midsection housing of the outboard motor and defines a first concave surface. A cover is configured to be mounted to the midsection housing over the pocket via a plurality of fasteners. The cover defines a second, oppositely concave surface on an inner face thereof. When the cover is mounted to the midsection housing over the pocket, the first concave surface and the second concave surface together form a cavity therebetween for holding a vibration isolation mount therein. One of the first concave surface and the second concave surface has a protrusion that extends into the cavity and contacts the mount held therein upon tightening of the plurality of fasteners to hold the cover over mount in the pocket. A mounting arrangement is also provided.

U.S. Pat. No. 8,932,093 discloses an outboard motor with a first damper member that is disposed between a bracket and a casing such that the first damper member supports a weight of an outboard motor body. A second damper member is disposed between the bracket and the casing. The casing or the bracket includes a left first inclined surface and a right first inclined surface. The left first inclined surface and the right first inclined surface are inclined with respect to a front-back direction of the outboard motor body in a planar view of the outboard motor body. The second damper member includes a left second inclined surface and a right second inclined surface. The left second inclined surface is arranged to oppose the left first inclined surface. The right second inclined surface is arranged to oppose the right first inclined surface.

Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one implementation of the present disclosure, a marine drive is provided. The marine drive includes a propulsion unit, a supporting cradle that couples the propulsion unit to a transom bracket for attachment to a marine vessel, and a cowling system that at least partially covers a portion of the propulsion unit and a portion of the supporting cradle. The cowling system includes multiple cowl components, and at least one of the multiple cowl components is coupled to the supporting cradle using an elastic cowl mount assembly. The elastic cowl mount assembly includes a conical bushing coupled to the cowl component, an external housing coupled to the supporting cradle, and a compliant body coupled to the conical bushing and the external housing. The compliant body permits radial and axial movement of the conical bushing relative to the external housing.

According to another implementation of the present disclosure, an elastic cowl mount assembly is provided that is configured to mount a cowl component to a structural member of an outboard motor. The elastic cowl mount assembly includes a conical bushing configured to couple to the cowl component. The conical bushing includes a first body portion, a second body portion, and a flange positioned between the first body portion and the second body portion. The elastic cowl mount assembly further includes an external housing configured to couple to the structural member and including a conical body extending from a mating flange, and a compliant body coupled to the second body portion of the conical bushing and the conical body of the external housing. The compliant body is configured to permit radial and axial translation of the conical bushing relative to the external housing.

According to yet another implementation of the present disclosure, a marine drive is provide. The marine drive includes a propulsion unit, a supporting cradle that couples the propulsion unit to a transom bracket for attachment to a marine vessel, and multiple cowl components including an upper cowl component that at least partially covers at least a portion of the propulsion unit and a middle cowl component positioned below the upper cowl component that at least partially covers a portion of the supporting cradle. The middle cowl component is coupled to the supporting cradle using an elastic cowl mount assembly include a conical bushing coupled to the middle cowl component, an external housing coupled to the supporting cradle, and a compliant body coupled to the conical bushing and the external housing. The compliant body permits radial and axial translation of the middle cowl component relative to the supporting cradle.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clearness and understanding. No unnecessary limitations are to be inferred therefrom beyond the requirement of the prior art because such terms are used for descriptive purposes only and are intended to be broadly construed.

Figure 1:
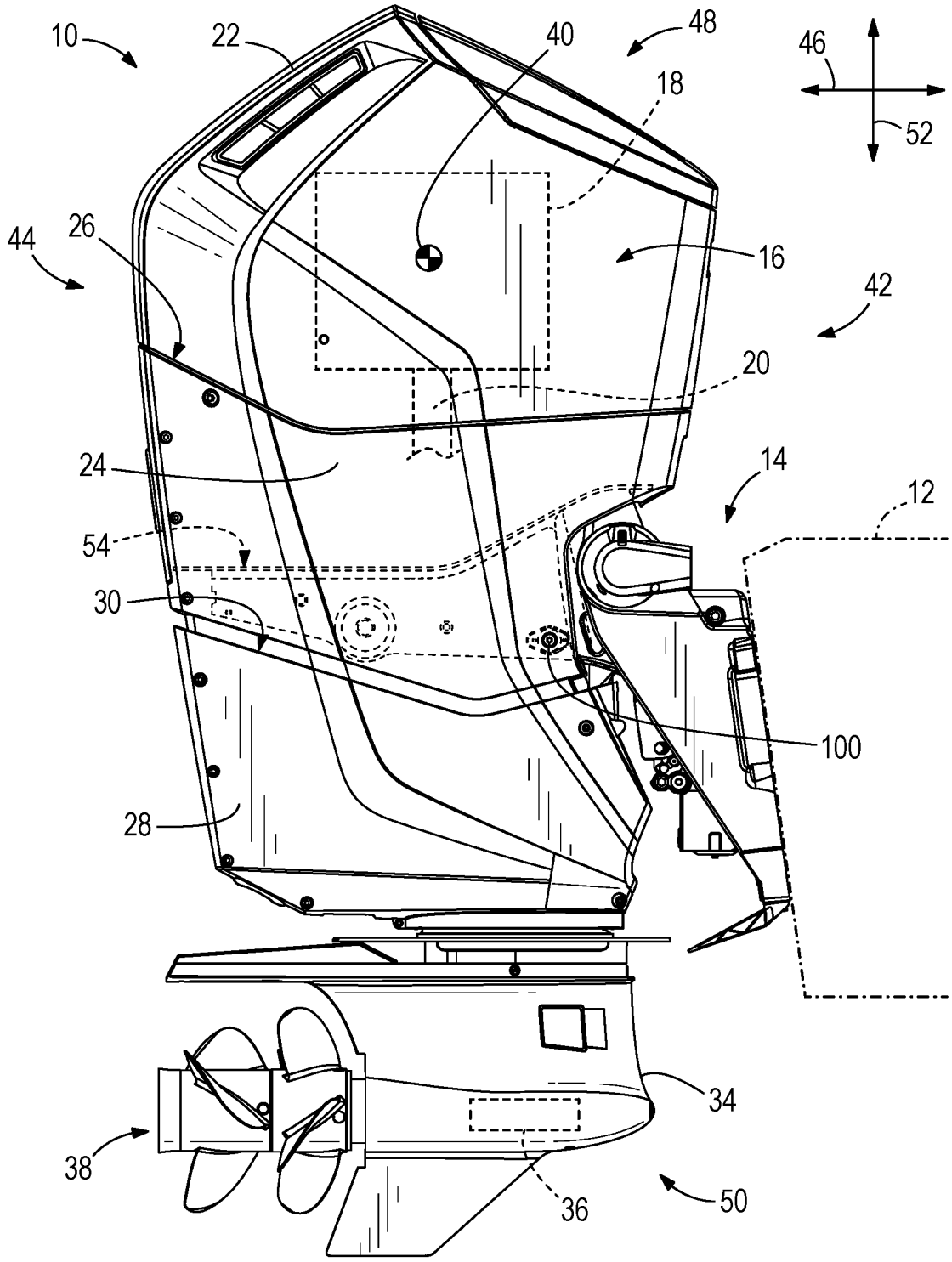
FIG. 1 is a side view of an outboard motor.

FIG. 1 depicts a starboard side view of an outboard motor or propulsion device 10 in accordance with an exemplary preferred embodiment of the present disclosure. In general, the outboard motor 10 extends between a forward side 42 and an aftward side 44 along a fore-aft axis 46, and between an upper side 48 and a lower side 50 along a vertical axis 52. Orthogonal to the fore-aft axis 46 and the vertical axis 52, the outboard motor 10 extends between a port side 56 and a starboard side 58 along a port-starboard axis 60 (depicted in FIG. 2). The outboard motor 10 is configured to be coupled to a transom 12 of a marine vessel via a transom bracket 14. A trim actuator may be coupled to the outboard motor 10 and the transom bracket 14 to trim the outboard motor 10 about a trim axis parallel to the port-starboard axis 60.

The outboard motor 10 is shown to include a cowling system with upper cowling 22, mid cowling or chap 24, and lower cowling 28 components. The upper cowling 22 covers a propulsion unit 16 including, for example, an internal combustion engine 18. In an exemplary implementation, the upper cowling 22 weighs approximately (i.e., ±10%) 49 lbs and has a center of gravity indicated by 40. The internal combustion engine 18 causes rotation of a generally vertically extending driveshaft 20. The engine 18 is supported by an isolation mounting cradle 32 that is coupled to the transom bracket 14. The isolation mounting cradle 32 may act to dampen vibrations induced by the engine 18 and other components to reduce the transmission of induced resonance and vibration running through the hull, cabin, and instruments of the marine vessel, resulting in quieter, more comfortable travel. The type and configuration of the supporting cradle 32 can vary from that which is shown. Various types and configurations of suitable supporting cradles are disclosed in U.S. Pat. Nos. 10,464,648; 9,969,475; 9,9632,213; and 9,701,383, each of which is incorporated herein by reference.

Rotation of the driveshaft 20 powers a propulsor 38 that is operably connected to the driveshaft 20 by a transmission gearset 36 that is located in a lower gearcase 34. In the illustrated example, the propulsor 38 includes multiple propellers. The type and configuration of the marine drive shown in the figures is for explanatory purposes only and can vary from what is shown.

Still referring to FIG. 1, the upper cowling 22 is mated with the mid cowling components 24 along a seam 26, and the upper cowling 22 can be removed from the mid cowling components 24 for access to the internal combustion engine 18. In an exemplary implementation, an engine compartment cradle seal 54 is positioned below the seam 26. When the outboard motor 10 is operated in a body of water, the portions of the outboard motor 10 above the engine compartment cradle seal 54 generally remain dry, while the portions of the outboard motor 10 below the seal 54 may be partially immersed or wetted. The mid and lower cowlings 24, 28 are separated by a dynamic gap 30. The dynamic gap 30 extends around the entire perimeter of the outboard motor 10 and is configured so that the mid and lower cowling components 24, 28 can move (e.g., vibrate, deflect, translate) with respect to each other.

Figure 2:
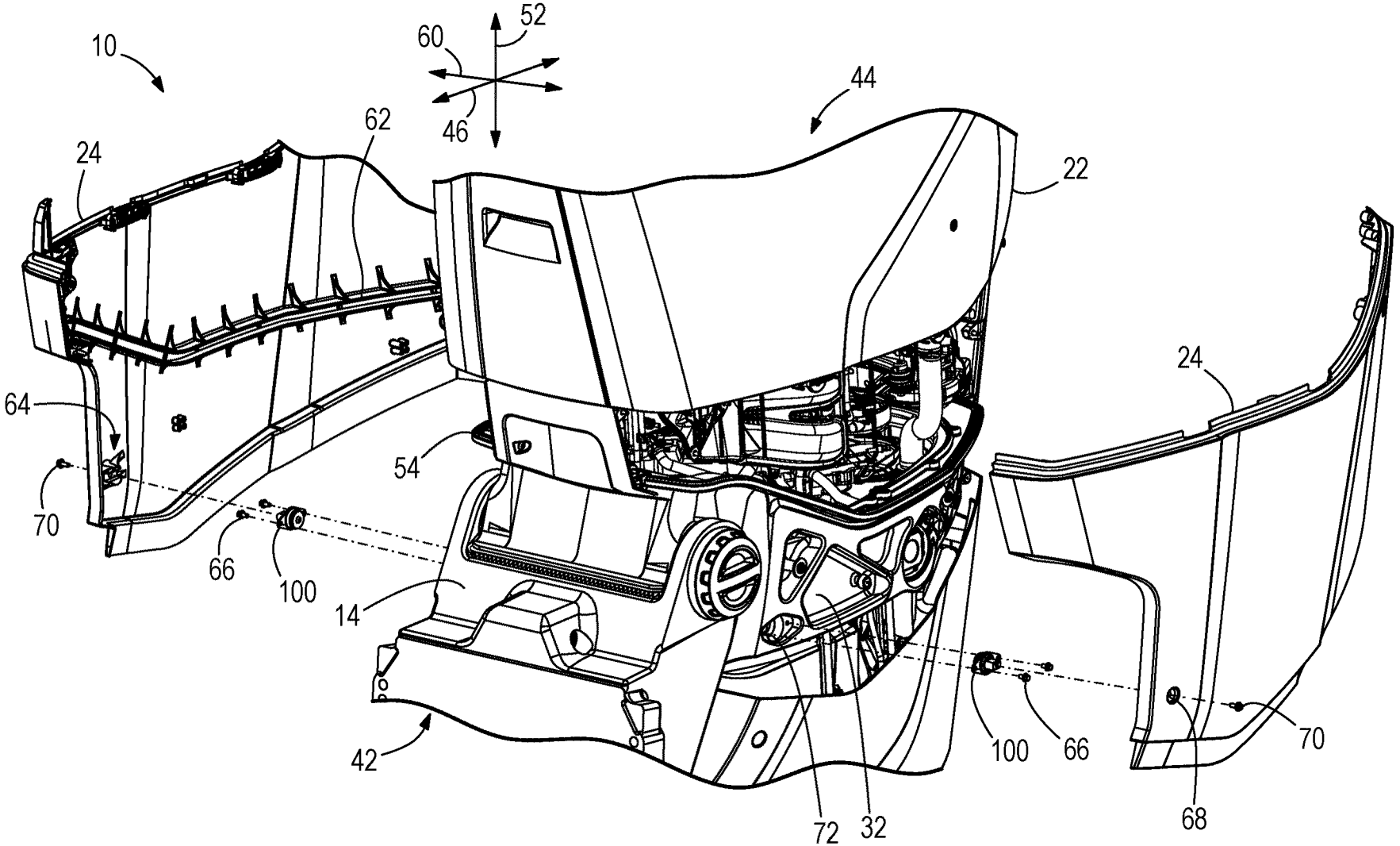
FIG. 2 is an exploded view of the mid-section of the outboard motor of FIG. 1.

As shown in the exploded view depicted in FIG. 2, in an exemplary implementation, the outboard motor 10 includes two generally symmetrical mid cowling or chap components 24, located on both the port side 56 and the starboard side 58. In some implementations, in addition to the port and starboard side components, the mid cowling portion of the cowling system may include additional fore and aft mid cowling components 24 located on the forward side 42 and the aftward side 44 of the outboard motor 10. Each of the port and starboard side components 24 may include a C-channel mount 62 extending along an interior surface of the components 24 in the fore-aft direction 46. Each C-channel mount 62 has a contour that permits the mount 62 to mate with the cradle seal 54, which extends around the perimeter of the isolation mounting cradle 32. The mating of the C-channel mounts 62 with the cradle seal 54 acts to locate the port and starboard side chap components 24 relative to the outboard motor 10.

Previous cowling systems included port and starboard chaps that wrapped around a propulsion unit and were directly fastened to each other. However, the present inventors have recognized the design and location of the isolation mounting cradle 32 prevents direct fastening of the chap components 24 to each other. Instead, fastening of the chap components 24 to the isolation mounting cradle 32 is required. The present inventors have further recognized that the joint between the chap components 24 and the isolation mounting cradle 32 must have sufficient compliance to prevent fracture of the chap components 24, and therefore rigid bolting of the chap components 24 to the isolation cradle is inadvisable.

Cowling systems are generally fabricated from sheet molding compound (SMC), a type of reinforced polyester composite that may contain resin, glass fibers, and hollow glass spheres. The presence of the hollow glass spheres significantly reduces the material density of the composite. Although SMC is lightweight, easy to produce, and impact resistant, it can fracture under high strain tensile loading conditions. Tensile loading conditions are of particular concern when the outboard motor 10 experiences dynamic loading due to rough water conditions or underwater object strikes. This is due to the forces and torques transmitted from the connection of the upper cowl 22, which includes a vertically high center of gravity 40 and a nominal weight of 49 lbs, to the chap components 24. To avoid imparting excess strain to the chap components 24 under dynamic loading, the present inventors have provided an elastic cowl mount assembly 100 to achieve an elastic joint with a radial stiffness of less than 200 N per deflection of 4.5 mm.

Below the C-channel mount 62, each of the port and starboard side chap components 24 includes opposing or upper and lower mounting prongs 64 extending from the interior surface and configured to receive the elastic cowl mount assembly 100. Advantageously, the design of the elastic cowl mount assembly 100 permits the chaps 24 to move relative to the isolation mounting cradle 32 both axially, that is, along the port-starboard axis 60, and radially, along the fore-aft axis 46 and the vertical axis 52. Each elastic cowl mount assembly 100 is configured to be rigidly mounted to a pocket 72 formed in the port side 56 or starboard side 58 of the isolation mounting cradle 32 using fasteners 66. Once each elastic cowl mount assembly 100 has been located and received by the upper and lower mounting prongs 64 of the port and starboard side chap components 24, fasteners 70 may be secured through holes 68 formed in the chap components 24 to provide a compliant joint between the chaps 24 and the isolation mounting cradle 32.

Figure 3:
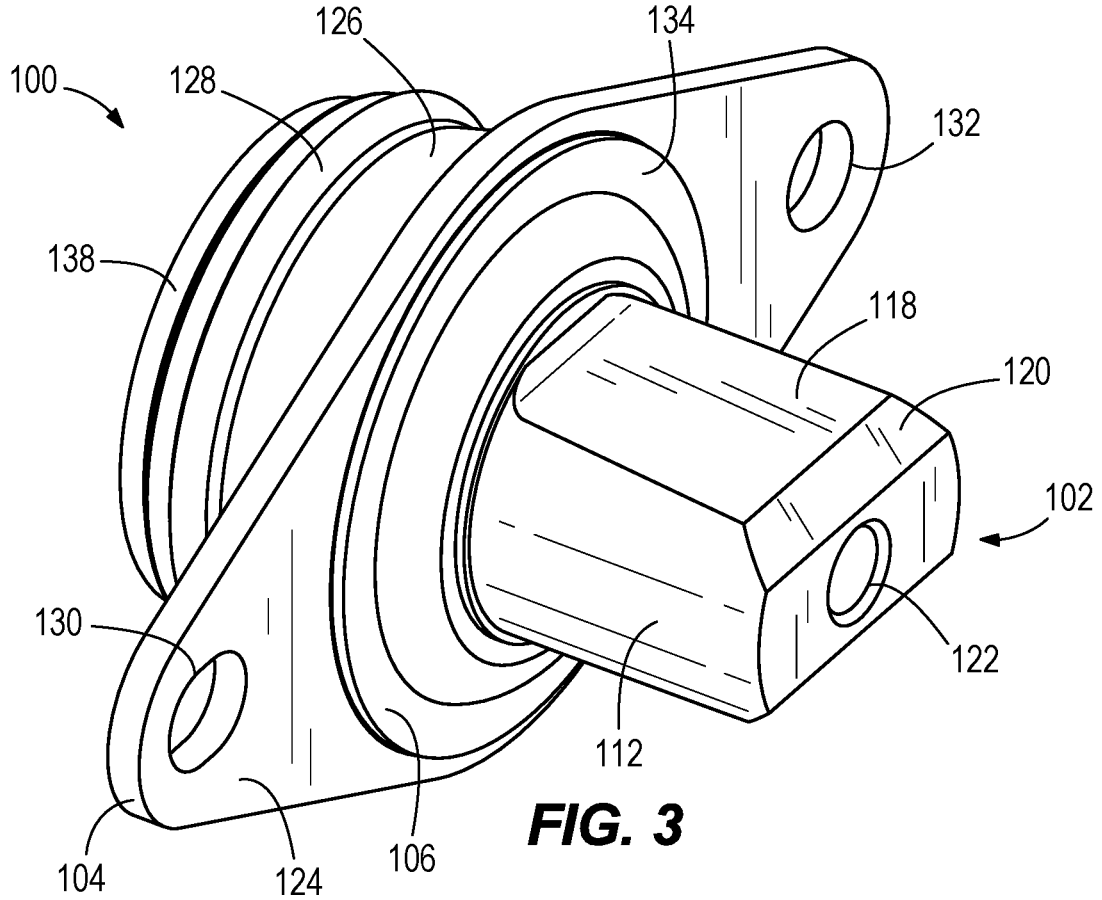
FIG. 3 is a perspective view of the elastic cowl mount assembly depicted in the mid-section of FIG. 2.
Figure 4:
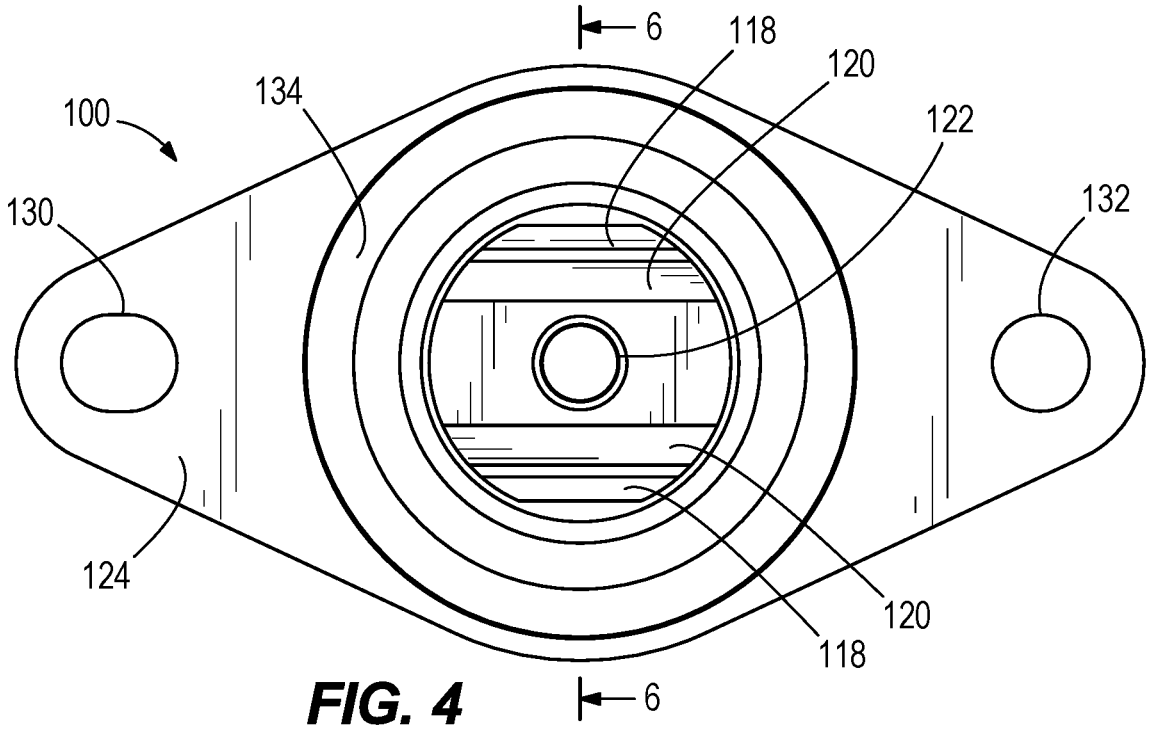
FIG. 4 is a front view of the elastic cowl mount assembly of FIG. 3.
Figure 5:
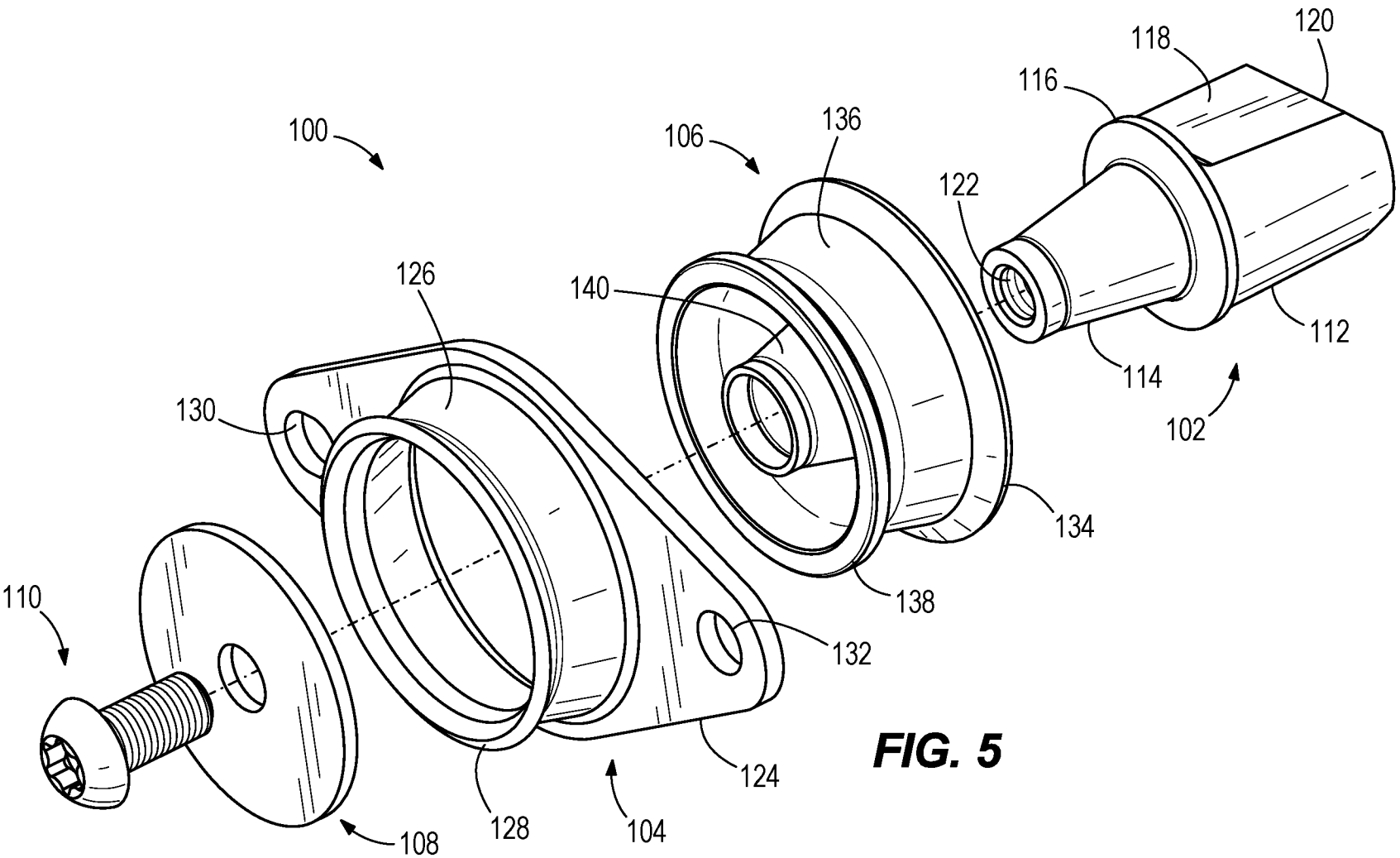
FIG. 5 is an exploded view of the elastic cowl mount assembly of FIG. 3.

Referring now to FIGS. 3-5, various views of the elastic cowl mount assembly 100 used to mount the chaps 24 to the isolation mounting cradle 32 are depicted, according to an exemplary implementation. Specifically, FIG. 3 depicts a perspective view of the mount assembly 100, FIG. 4 depicts a front view of the mount assembly 100, and FIG. 5 depicts an exploded view of the mount assembly 100. The elastic cowl mount assembly 100 is shown to include a conical bushing 102, an external housing 104, a compliant or rubber body 106, a washer 108, and a retaining fastener 110.

The conical bushing 102 is shown to be coupled to the external housing 104 using the rubber body 106. As shown in FIG. 5, the conical bushing 102 includes a first body portion 112 and a second body portion 114. The first body portion 112 and the second body portion 114 are separated by a flange 116. When assembled into the mount assembly 100 as depicted in FIG. 3, the flange 116 sits flush against the rubber body 106 such that the first body portion 112 extends outwardly from the external housing 104 and the second body portion 114 is located within the rubber body 106. Further details regarding the mating of the conical bushing 102, the external housing 104, and the rubber body 106 are included below.

Figure 6:
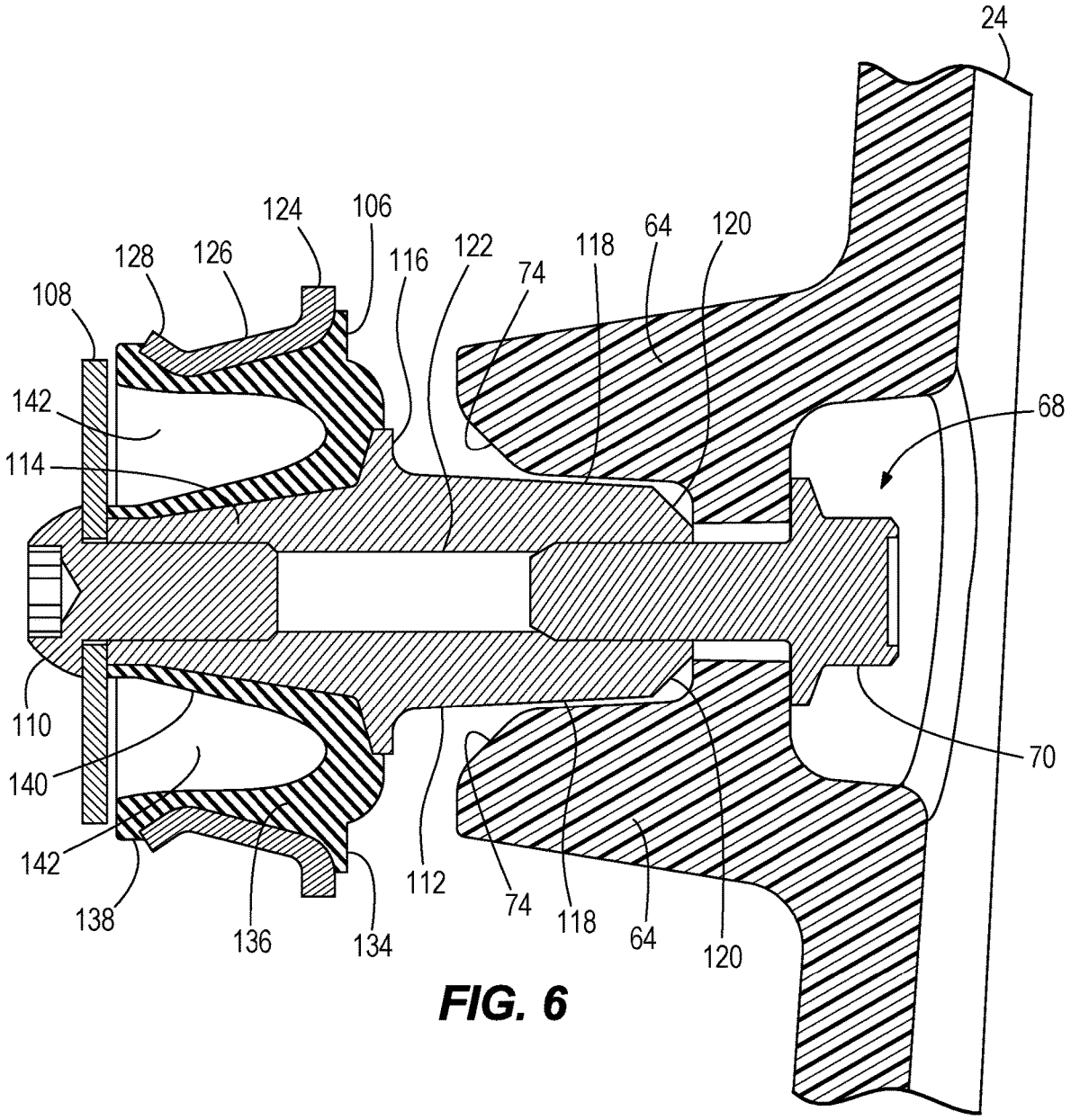
FIG. 6 is a side cross-sectional view of the outboard motor of FIG. 1 depicting the mounting arrangement of the chap to the cradle using the elastic cowl mount assembly.
Figure 7:
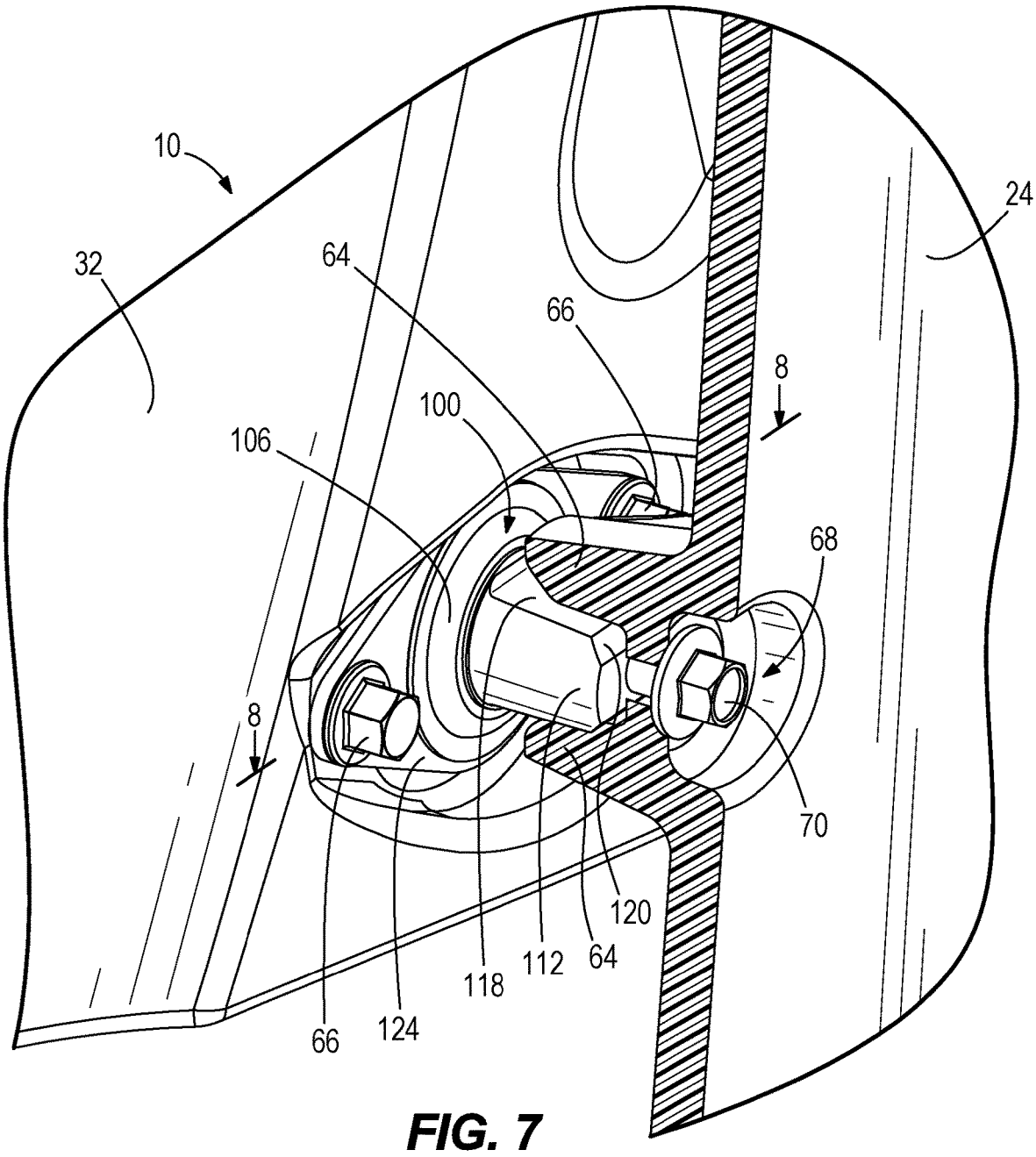
FIG. 7 is a partial sectional view of the mounting arrangement of FIG. 6.

The first body portion 112 of the conical bushing 102 is generally cylindrically shaped with opposing or upper and lower flat surfaces 118 formed therein. The flat surfaces 118 are keyed to the mounting prongs 64 on the chap 24, as depicted in FIGS. 6 and 7 below. In addition to the upper and lower flat surfaces 118, the first body portion 112 includes upper and lower leading edge flats 120. The leading edge flats 120 slope respectively downwardly and upwardly from the upper and lower flat surfaces 118 to assist in aligning the conical bushing 102 between the mounting prongs 64 of the chap 24. The second body portion 112 is shown to have a generally frustoconical shape. The frustoconical shape of the second body portion 112 permits a larger clearance region for the rubber body 106 (depicted as clearance region 142 in FIG. 6) than would otherwise be available if the second body portion 112 had a cylindrical shape. Advantageously, this larger clearance region results in greater radial compliance available to the joint.

A threaded hole 122 extends through the first body portion 112 and the second body portion 114 of the conical bushing 102. A portion of the threaded hole 122 located in the first body portion 112 is configured to receive the cowl mount fastener 70 (depicted in FIGS. 6-8) that clamps the chap component 24 to the isolation cradle 32. Another portion of the threaded hole 122 located in the second body portion 114 is configured to receive the retaining fastener 110. Washer 108 is positioned flush against the second body portion 114 and the retaining fastener 110.

In an exemplary implementation, the conical bushing 102 is fabricated from anodized aluminum. Advantageously, anodized aluminum has high hardness, low weight, and a corrosion resistant coating that cannot chip or peel. Thus, anodized aluminum is particularly well-suited to withstand the high humidity, salt spray, and fuel routinely encountered in marine environments.

As specifically depicted in FIG. 5, the external housing 104 is shown to include a mating flange 124 and a conical body 126 extending therefrom. The conical body 126 terminates in an outwardly extending lip 128. The mating flange 124 has a generally rounded diamond shape (best depicted in FIG. 4) and includes both an oval-shaped slotted opening 130 and a circular-shaped opening 132. The oval-shaped slotted opening 130 accounts for lateral tolerances in mating holes formed in the pockets 72 (depicted in FIG. 2) of the isolation cradle 32 as well as tolerances in the external housing 104 without permitting rotation of the mount assemblies 100 within the pockets 72. Maintaining correct alignment of the mount assemblies 100 within the pockets 72 is critical, as rotational misalignment may prevent the keyed flat surfaces 118 of the conical bushing 102 from fitting between the mounting prongs 64 of the chap 24, and the C-channel mounts 62 from mating with the cradle seal 54.

The compliant body 106 is shown to include an outer conical portion 136 that extends between a first flange 134 and a second flange 138. In an exemplary embodiment, the compliant body 106 is fabricated from polychloroprene rubber, also known as neoprene. Neoprene is well-suited for marine applications because it does not physically degrade over a wide range of temperatures and environmental conditions, and it is durable over a high number of dynamic loading cycles. The rubber body 106 may be overmolded onto the external housing 104 and the conical bushing 102 such that the first flange 134 of the rubber body 106 extends radially outward over the mating flange 124 of the external housing 104, and the second flange of the rubber body 106 extends radially outward over the lip 128 of the external housing 104. In addition, the overmolding process may form an inner conical portion 140 of the rubber body 106 that couples to the second body portion 114 of the bushing 102. In an exemplary implementation, the external housing 104 is fabricated from austenitic stainless steel because it is corrosion resistant and provides a good bonding surface for the rubber body 106. The washer 108 and the retaining fastener 110 may also be fabricated from austenitic stainless steel.

FIG. 6 depicts a side cross-sectional view of the elastic cowl mount assembly 100 secured to a chap component 24. (Note: the isolation cradle 32 is omitted from this view). As shown, the first body portion 112 of the conical bushing 102 is configured to fit within the opposing prongs 64 extending from the interior surface of the chap component 24. As described above, the leading edge flats 120 act to assist in guiding the first body portion 112 into a proper mating position between the prongs 64. In an exemplary implementation, the prongs 64 also include leading edge flats 74 to ease the mating of the mount assembly 100 to the chap component 24.

The fastener 70 (e.g., a socket head screw) is shown to pass through hole 68 in the chap 24 to couple the chap component 24 to the first body portion 112 of the conical bushing 102. In an exemplary embodiment, the hole 68 is a counterbore hole that permits the head of the fastener 70 to reside entirely within the hole 68, thus providing a smooth and attractive exterior surface to the chap component 24.

Advantageously, once the first body portion 112 is fully seated within the prongs 64, the presence of the opposing flat surface 118 on the first body portion 112 prevents rotation of the conical bushing 102, even as torque is applied to the fastener 70. In this way, rotation of the conical bushing 102 that might otherwise cause a shear failure of the overmolded connection between the compliant body 106 and the conical bushing 102 is prevented. If additional alignment assistance is necessary during installation of a chap component 24, an alignment stud may be temporarily installed in place of the fastener 70 to facilitate alignment of the first body portion 112 between the prongs 64 while the C-channel mount 62 is mated with the cradle seal 54. The alignment stud may be removed and replaced with the fastener 70 to complete the assembly after the chap component 24 is in its final installation position.

The compliant body 106 is shown to include a clearance region 142 formed between the outer conical portion 136 and the inner conical portion 140. The clearance region 142 permits the conical bushing 102 to translate relative to the external body 104 in both radial and axial directions, thus mitigating the potential high strains imparted to the chap component 24 by the upper cowl 22 under dynamic loading conditions. As described above, the size of the clearance region 142, and thus the permissible translation of the conical bushing 102 is maximized due to the frustoconical shape of the second body portion 114 of the conical bushing 102.

Figure 8:
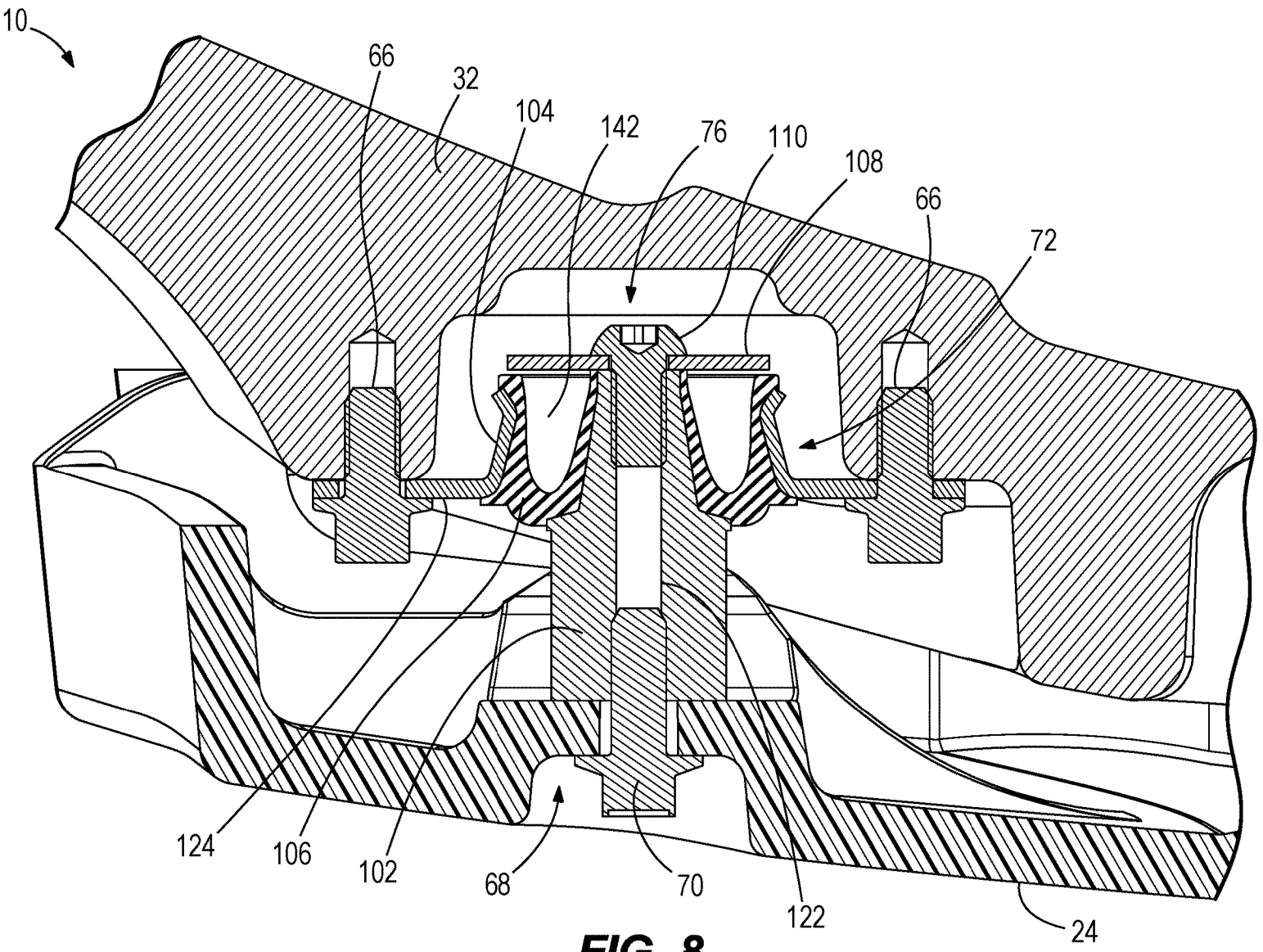
FIG. 8 is a top cross-sectional view of the mounting arrangement taken along the line 8-8 of FIG. 7.

Turning now to FIGS. 7 and 8, side and top cross-sectional views of a port side elastic cowl mount assembly 100 coupled to the isolation cradle 32 and the chap component 24 are respectively depicted. As shown, the cowl mount assembly 100 resides within a pocket 72 formed in the isolation cradle 32. In an exemplary implementation, the external housing 104 of the mount assembly 100 is fixedly coupled to the pocket 72 using a pair of fasteners 66. As specifically depicted in FIG. 8, the pocket 72 may include a central pocket region 76 that is at least as large in diameter as the washer 108 to permit free axial movement of the conical bushing 102, washer 108, and retention fastener 110 relative to the external housing 104.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A marine drive comprising:

a propulsion unit;

a supporting cradle that couples the propulsion unit to a transom bracket for attachment to a marine vessel; and a cowling system that at least partially covers a portion of the propulsion unit and a portion of the supporting cradle, the cowling system comprising a plurality of cowl components;

wherein at least one of the plurality of cowl components is coupled to the supporting cradle using an elastic cowl mount assembly, the elastic cowl mount assembly comprising:

a conical bushing coupled to the cowl component;

an external housing coupled to the supporting cradle; and a compliant body coupled to the conical bushing and the external housing, the compliant body permitting radial and axial translation of the conical bushing relative to the external housing.

2. The marine drive of claim 1, wherein the compliant body is coupled to the conical bushing and the external housing using an overmolding process.

3. The marine drive of claim 1, wherein the conical bushing is fabricated from anodized aluminum.

4. The marine drive of claim 1, wherein the compliant body is fabricated from neoprene.

5. The marine drive of claim 1, wherein the conical bushing comprises a first body portion, a second body portion, and a flange positioned between the first body portion and the second body portion.

6. The marine drive of claim 5, wherein the first body portion of the conical bushing further comprises a pair of opposing flat surfaces.

7. The marine drive of claim 6, wherein the cowl component comprises a pair of opposing prongs extending from an interior surface of the cowl component.

8. The marine drive of claim 7, wherein the pair of opposing flat surfaces of the first body portion of the conical bushing are configured to fit between the pair of opposing prongs of the cowl component.

9. The marine drive of claim 1, wherein the external housing comprises a mating flange having a slotted opening and a circular opening.

10. The marine drive of claim 1, further comprising an engine compartment seal extending around a perimeter of the supporting cradle.

11. The marine drive of claim 10, wherein the cowl component further comprises a C-channel mount extending from an interior surface of the cowl component, the C-channel mount configured to mate with the engine compartment seal.

12. An elastic cowl mount assembly configured to mount a cowl component to a structural member of an outboard motor, the elastic cowl mount assembly comprising:

a conical bushing configured to couple to the cowl component, the conical bushing comprising a first body portion, a second body portion, and a flange positioned between the first body portion and the second body portion;

an external housing configured to couple to the structural member, the external housing comprising a conical body extending from a mating flange; and a compliant body coupled to the second body portion of the conical bushing and the conical body of the external housing, the compliant body configured to permit radial and axial translation of the conical bushing relative to the external housing.

13. The elastic cowl mount assembly of claim 12, wherein the compliant body is coupled to the second body portion of the conical bushing and the conical body of the external housing using an overmolding process.

14. The elastic cowl mount assembly of claim 12, wherein the conical bushing is fabricated from anodized aluminum.

15. The elastic cowl mount assembly of claim 12, wherein the compliant body is fabricated from neoprene.

16. The elastic cowl mount assembly of claim 12, wherein the first body portion comprises a pair of opposing flat surfaces.

17. The elastic cowl mount assembly of claim 12, wherein the mating flange comprises a slotted opening and a circular opening.

18. A marine drive comprising:

a propulsion unit;

a supporting cradle that couples the propulsion unit to a transom bracket for attachment to a marine vessel; and a plurality of cowl components including an upper cowl component that at least partially covers at least a portion of the propulsion unit and a middle cowl component positioned below the upper cowl component that at least partially covers a portion of the supporting cradle;

wherein the middle cowl component is coupled to the supporting cradle using an elastic cowl mount assembly, the elastic cowl mount assembly comprising:

a conical bushing coupled to the middle cowl component;

an external housing coupled to the supporting cradle; and a compliant body coupled to the conical bushing and the external housing, the compliant body permitting radial and axial translation of the middle cowl component relative to the supporting cradle.

19. The marine drive of claim 18, wherein the middle cowl component comprises a pair of opposing prongs extending from an interior surface of the middle cowl component.

20. The marine drive of claim 19, wherein the conical bushing comprises a pair of opposing flat surfaces configured to fit within the opposing prongs of the middle cowl component and prevent rotation of the conical bushing relative to the compliant body.

* * * * *